US007280795B2

(12) United States Patent
Kakishima et al.

(10) Patent No.: US 7,280,795 B2
(45) Date of Patent: Oct. 9, 2007

(54) COOLING TRANSPORT DEVICE AND IMAGE FORMING APPARATUS

(75) Inventors: Aya Kakishima, Kanagawa (JP); Jyunpei Amano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 253 days.

(21) Appl. No.: 11/213,811

(22) Filed: Aug. 30, 2005

(65) Prior Publication Data

US 2006/0210333 A1 Sep. 21, 2006

(30) Foreign Application Priority Data

Mar. 15, 2005 (JP) ..... P2005-073454

(51) Int. Cl.
*G03G 15/20* (2006.01)

(52) U.S. Cl. ..... 399/341; 399/407

(58) Field of Classification Search ..... 399/341, 399/407

See application file for complete search history.

(56) References Cited

U.S. PATENT DOCUMENTS 6,771,926 B2 * 8/2004 Ishikawa et al. ..... 399/341
2004/0067082 A1 * 4/2004 Uehara et al. ..... 399/341

FOREIGN PATENT DOCUMENTS

JP 2003-233227 8/2003

* cited by examiner

*Primary Examiner*—David M. Gray
*Assistant Examiner*—Ryan D. Walsh
(74) *Attorney, Agent, or Firm*—Morgan, Lewis & Bockius LLP

(57) ABSTRACT

A cooling transport device includes: a rotating member that is provided with an elastic layer; an endless belt member that transports a recording medium between the rotating member and the belt member, the belt member being in contact under pressure with the rotating member to form a nip area and rotated by the rotating member; and a heat absorbing pressing member that presses the belt member in the nip area against the rotating member and absorbs heat from the recording medium, the heat absorbing pressing member being provided on the inner surface side of the belt member.

14 Claims, 8 Drawing Sheets

COOLING TRANSPORT DEVICE AND IMAGE FORMING APPARATUS

BACKGROUND OF THE INVENTION

1. Field of the Invention

The present invention relates to a cooling transport device for use in an image forming apparatus such as a copying machine or a facsimile apparatus to cool and transport a recording medium on which an unfixed toner image is thermally fused and fixed, and the image forming apparatus using the cooling transport device.

2. Description of the Related Art

In conventional copying machines or printers of electrophotography, a thermal fixing method has been well known in which the unfixed toner image on the recording medium is thermally fused and fixed. However, if the fixing is sped up or repeated continuously, the toner is less hardened because the recording medium after fixing is cooled insufficiently, whereby it was apprehended that the sheets might adhere to each other due to less hardened toner between discharged recording mediums. Moreover, the charged toner was affected by the exhaust heat from the recording medium caused by transporting the recording medium after fixing at the time of printing on both sides, whereby it was apprehended that the image abnormality such as uneven density might occur.

In order to solve those problems, the cooling transport device that compulsorily cools the recording medium immediately after fixing is well known (e.g., refer to JP-A-2003-233227).

In the document JP-A-2003-233227, a cooling method is proposed in which a pair of rotation bodies having a heat absorbing roll 101 with an elastic layer 101*a* and a roll 102 composed of a heat pipe are pressed against each other to form a nip area, and to tenaciously transport and cool the recording medium 103 immediately after fixing through this nip area, as shown in FIG. 8A.

Additionally, in this patent document, another cooling method was proposed in which a transporting belt 106 having good thermal conductivity is bridged between a roll 104 composed of a heat pipe and another roll 105, and the heat absorbing roll 101 with the elastic layer 101*a* is opposed to the transporting belt 106 to form a wide nip area, and transport and cool the recording medium 103 after fixing on the transporting belt 106, as shown in FIG. 8B.

However, since it is difficult to take a wide nip area in the type of transporting the recording medium between one pair of rotation bodies, the effect of cooling the recording medium was insufficient. On the other hand, in the type of using the transporting belt, though the wide nip area could be taken, the recording medium was cooled owing to the cooling effect of the transporting belt itself, in which there was a problem that the cooling effect in the nip area was impaired because the coolness of the transporting belt was lost before reaching the nip area.

SUMMARY OF THE INVENTION

According to an aspect of the invention, there is provided a cooling transport device including: a rotating member that is provided with an elastic layer; an endless belt member that transports a recording medium between the rotating member and the belt member, the belt member being in contact under pressure with the rotating member to form a nip area and rotated by the rotating member; and a heat absorbing pressing member that presses the belt member in the nip area against the rotating member and absorbs heat from the recording medium, the heat absorbing pressing member being provided on the inner surface side of the belt member.

BRIEF DESCRIPTION OF THE DRAWINGS

In the accompanying drawings:

FIGS. 5A and 5B are explanatory views showing the variations of the cooling transport device according to the second embodiment, in which FIG. 5A is a schematic view and FIG. 5B is a cross-sectional view taken along the line Vb-Vb shown in FIG. 5A;

DETAILED DESCRIPTION OF THE INVENTION

Embodiments of the invention will be described with reference to the drawings.

First Embodiment

Figure 1:
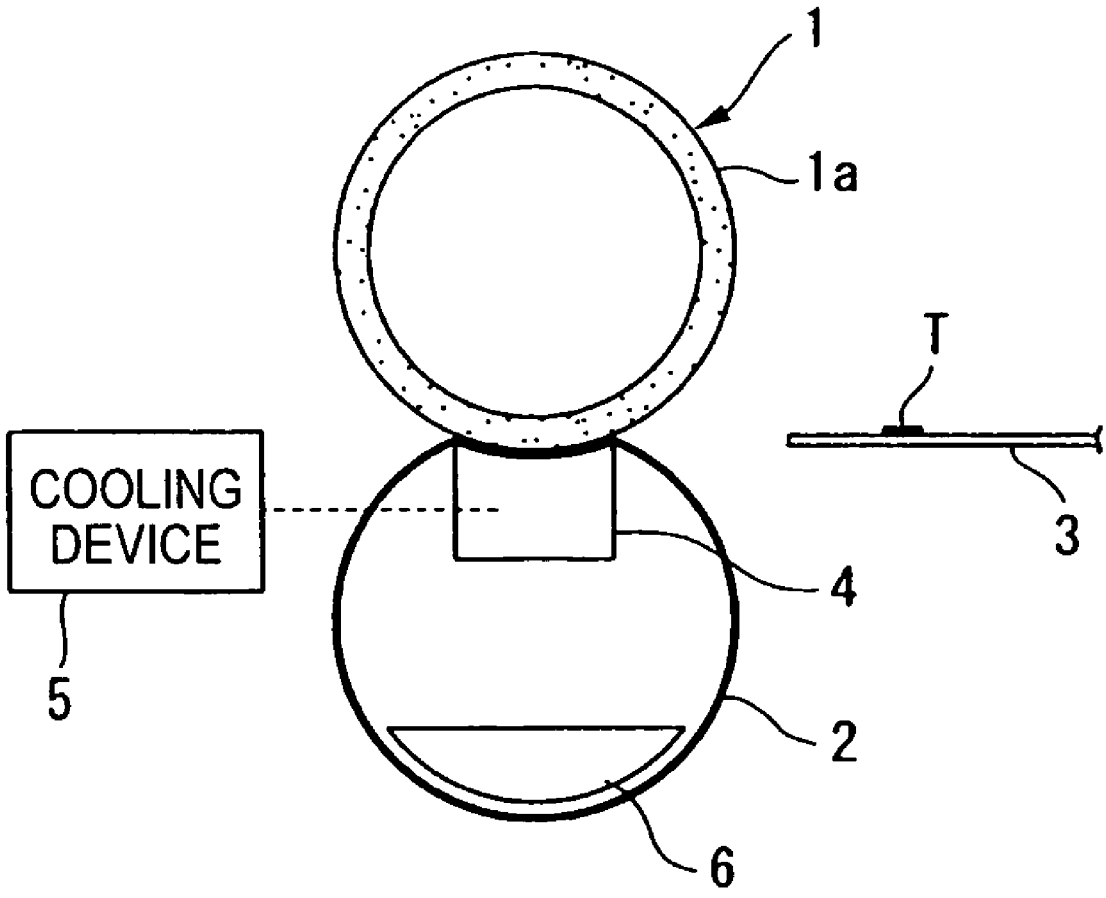
FIG. 1 is an explanatory view schematically showing a cooling transport device according to a first embodiment.

As shown in FIG. 1, a cooling transport device according to a first embodiment includes: a rotating member 1 with an elastic layer 1*a*; an endless belt member 2 for transporting a recording medium 3 between the rotating member 1 and the belt member 2, the belt member being contacted under pressure with the rotating member 1 and rolling along with the rotating member 1, and a heat absorbing pressing member 4 for pressing the belt member 2 in a predetermined area against the rotating member 1 and absorbing heat from the recording medium 3, the heat absorbing pressing member being provided on the inner surface side of the belt member 2.

The rotating member 1 is provided with the elastic layer 1*a* and is configured to be elastically deformable. The rotating member 1 may be provided with a thin layer having good thermal conductivity such as a metallic thin film or a releasing layer such as fluororesin layer on the surface of the rotating member 1. The rotating member 1 may be provided with a releasing layer on the surface of thin layer such as metallic thin layer. When a highly thermally conductive layer is provided on the surface of the rotating member 1, the effect of absorbing heat from the recording medium 3 to the rotating member 1 is added, causing the heat from the recording medium 3 to be deprived more easily to increase the cooling effect. Also, it is possible to prevent the toner T from adhering to the recording medium 3 by applying the releasing layer on the surface of the rotating member 1.

The belt member 2 may be configured as a metallic melt or a resin belt, as far as it has the heat resisting property, and may be the single layer or composite layer structure.

The heat absorbing pressing member 4 forms a predetermined nip area when the belt member 2 is pressed against the rotating member 1. To increase the cooling efficiency, it is preferable to secure the nip area as widely as possibly. Also, it is necessary that the heat absorbing pressing member 4 can absorb heat from the recording medium 3. The heat absorbing pressing member 4 may be composed of a material having high thermal conductivity such as metal, although it does not matter that the configuration of member has a heat absorbing function part as a whole or in a part (inside or on the surface). Also, as far as the heat absorbing effect from the recording medium 3 is obtained, the resin filled with a highly thermally conductive filler may be employed.

Moreover, as far as the predetermined nip area is secured widely, a shape of the nip area may be arbitrary such as a convex shape on the side of the rotating member 1, a convex shape on the side of the heat absorbing pressing member 4, or a horizontal shape.

The heat absorbing pressing member 4 is connected to a cooling device 5 for circulating a cooling medium therethrough. According to this configuration, the heat absorbing from the recording medium 3 can be increased.

The cooling device 5 may be a water cooling device, whereby the heat absorbing pressing member 4 can be cooled effectively and cheaply, and the heat absorbing action from the recording medium 3 maintained stable.

At least one contact face of the belt member 2 and the heat absorbing pressing member 4 has a low friction layer for reducing the frictional resistance between them. By applying this low friction layer, the rotation operation of the belt member 2 becomes smoother, suppressing the belt walk from occurring. Also, there is less influence on transporting the recording medium 3, suppressing the crumpled paper from occurring.

The low friction layer may be formed by coating the inner surface of the belt member 2 with a lubricant, in which the frictional resistance between the belt member 2 and the heat absorbing pressing member 4 is reduced with a simple configuration so that the rotation operation of the belt member 2 becomes smoother.

The belt member 2 may be made of metal, whereby the high heat conductivity of the belt member 2 is secured, and the heat absorption from the recording medium 3 to the heat absorbing pressing member 4 is made more effectively.

In the embodiment, the width of the nip area between the rotating member 1 and the belt member 2 in a direction of rotation axis may be larger than the maximum width of the recording medium 3 used.

In the embodiment, from the viewpoint of making the belt walk control unnecessary and reducing the size of the device, the rotating member 1 may have a drive source, and the belt member 2 may be rotated by the rotating member 1. In this case, if a guide member 6 for guiding a moving path of the belt member 2 is provided inside the belt member 2, it is possible to suppress unwanted variation of the belt member 2, whereby the rotation operation of the belt member 2 becomes smoother. A layer (e.g., releasing layer) for reducing the frictional resistance with the belt member 2 may be provided on the surface of the guide member 6 on the side of the belt member 2.

The configuration described above and with reference to FIG. 1 may be applied to an image forming apparatus. In this case, the image forming apparatus further includes an image carrier for carrying a toner image, a transfer unit for transferring the toner image on the image carrier onto a recording medium 3, a fixing unit for heating and fixing the toner image transferred onto the recording medium 3, and the above-described cooling transport device for cooling the recording medium 3 after fixing. In a form of the fixing simultaneous with transferring, the transfer unit may be also employed as the fixing unit.

The recording medium 3 may be transported so that the fixed toner image T faces the side of the rotating member 1. By disposing the fixed toner image T on the side of the rotating member 1 that is elastically deformable, it is possible to suppress the occurrence of image disorder in the nip area between the rotating member 1 and the heat absorbing pressing member 4.

Second Embodiment

Figure 2:
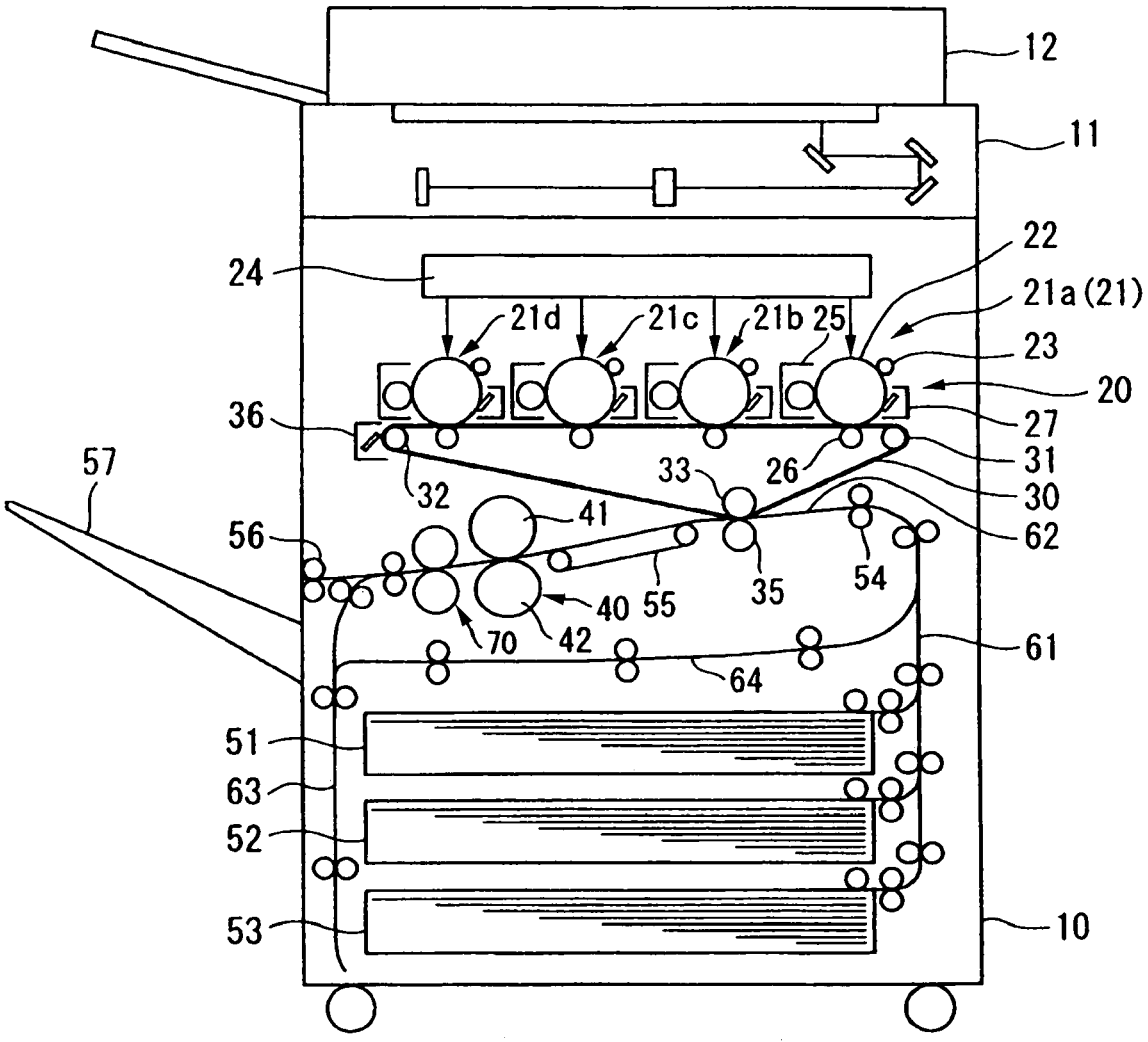
FIG. 2 is an explanatory view showing an image forming apparatus using the cooling transport device according to a second embodiment.

FIG. 2 shows an image forming apparatus according to a second embodiment of the invention. As shown in FIG. 2, the image forming apparatus according to the second embodiment includes an apparatus main body 10 having an image forming unit 20 that can form a color image, an image reading unit 11 for reading the original on the top of the apparatus main body 10, an original feeding device 12 for feeding the original to the image reading unit 11 above the image reading unit 11, and the drawable sheet feeding cassettes 51 to 53 of multiple stages for supplying the sheet as the recording medium under the image forming unit 20 of the apparatus main body 10.

The image forming unit 20 for use in the embodiment employs an electrophotographic method, for example, and is a so-called tandem type in which the image forming units 21 (21*a* to 21*d*) of four colors of yellow (Y), magenta (M), cyan (C) and black (K) are arranged in parallel on an intermediate transfer belt 30. Therefore, the toner images of four colors formed by the image forming units 21 (21*a* to 21*d*) are primarily transferred sequentially onto the intermediate transfer belt 30 and made multiple. The multiple toner images are collectively transferred onto the sheet supplied from the sheet feeding cassettes 51 to 53 by a secondary transfer device 35, and the sheet is led to a fixing device 40 and then to a cooling transport device 70. The image forming units 21 of four colors do not need to be disposed in this order, but may be disposed in the other orders.

The image forming units 21 (21*a* to 21*d*) of the embodiment comprise the photosensitive drums 22 for forming and carrying the color component toner images, the charging devices 23 such as charging rolls for charging the photosensitive drums 22, a laser exposure device 24 for forming the latent images on the charged photosensitive drums 22, the developing devices 25 for developing the electrostatic latent images on the photosensitive drums 22, the primary transfer devices 26 composed of primary transfer rolls for primarily transferring the toner images on the photosensitive drums 22 onto the intermediate transfer belt 30, and the cleaning devices 27 for cleaning the residual toner remaining on the photosensitive drums 22. In the embodiment, the laser exposure device 24 is singly provided to expose all the image forming units 21 of four colors to light.

The intermediate transfer belt 30 is stretched around a plurality of stretching rolls 31 to 33, and transported circularly with a stretching roll 31 as a driving roll, for example. A secondary transfer device 35 composed of a secondary transfer roll is disposed opposite to a stretching roll 33 as a backup roll. A belt cleaning device 36 for removing the residual toner on the intermediate transfer belt 30 is disposed at a position opposite to a stretching roll 32 of this intermediate transfer belt 30.

Herein, a sheet transport system of the embodiment is configured as follows. The sheet transport system includes a vertical transporting path 61 extending vertically upward from the sheet feeding cassettes 51 to 53, a main transporting path 62 extending horizontally on the downstream side of the vertical transporting path 61, a refuge transporting path 63 extending downward like Y-character near the most downstream side of the main transporting path 62 and a reversal transporting path 64 extending horizontally from the middle of the refuge transporting path 63 up to the vertical transporting path 61.

The main transporting path 62 is provided with a registration roll 54 for regulating the positioning of the sheet, the secondary transfer device 35 for transferring collectively the multiple toner images on the intermediate transfer belt 30, a transporting belt 55 for transporting the sheet on which the toner images are transferred collectively, the fixing device 40 for fixing the toner images on the sheet, the cooling transport device 70 for transporting the sheet immediately after fixing while cooling it, and a sheet exhausting roll 56, provided sideways of the apparatus main body 10, for exhausting the sheet into a paper output tray 57 for stacking the sheets.

On these transporting paths 61 to 64, the transporting members such as a transporting roll and a transporting guide are adequately disposed to securely transport the sheet.

The fixing device 40 of the embodiment fixes the toner by heating and fusing the toner, and includes a heating roll 41 internally having a heating source such as a halogen lamp and a pressure roll 42 disposed opposite to the heating roll 41.

Figure 3:
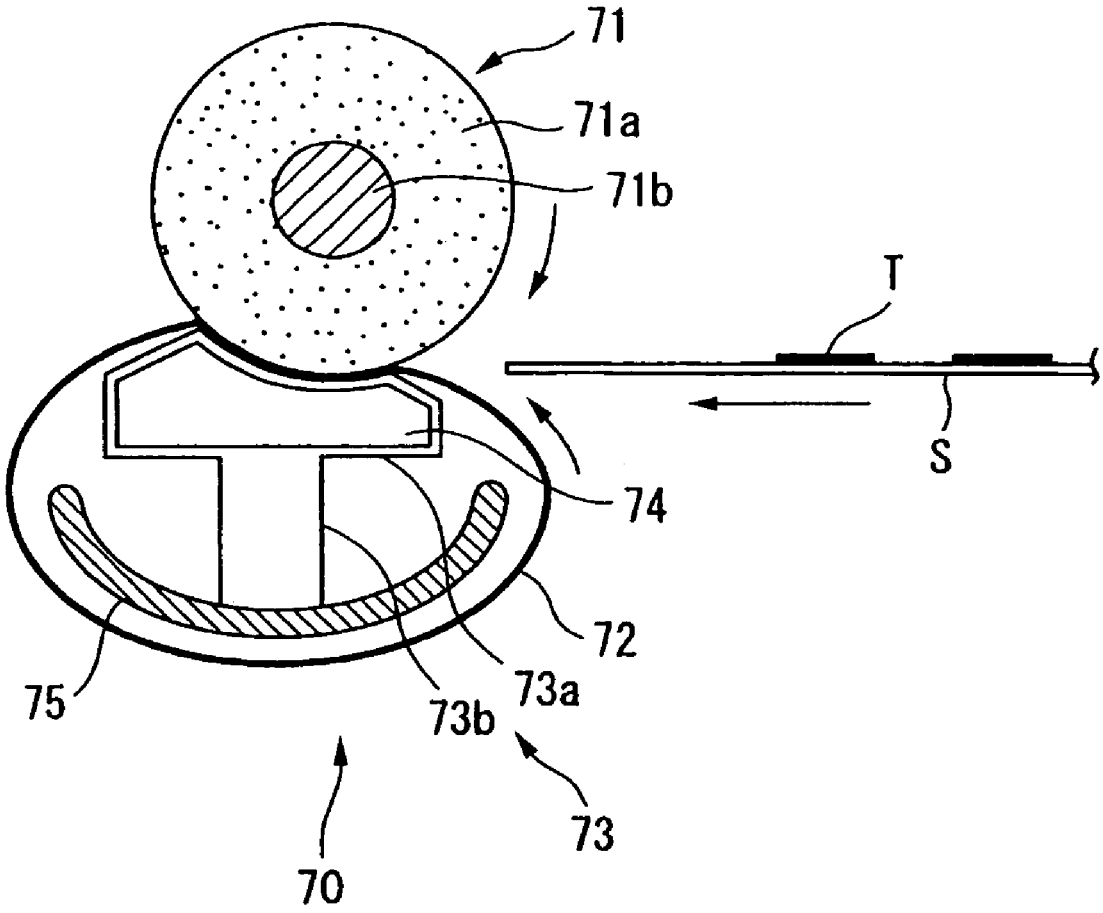
FIG. 3 is an explanatory view showing the cooling transport device according to the second embodiment.

The cooling transport device 70 of the embodiment is configured as shown in FIG. 3. As shown in FIG. 3, the cooling transport device 70 has an elastic roll 71 with an elastic layer 71*a* disposed on the toner face side of the sheet S, and includes the main components of an endless belt 72 rolling along with this elastic roll 71 to transport the sheet S between the roll and the belt, and a pressing member 73 for pressing the endless belt 72 against the elastic roll 71 by contacting with the back face of the endless belt 72, as well as absorbing heat from the sheet S while being transported between the elastic roll 71 and the endless belt 72.

To rotate the endless belt 72 sufficiently, and enable the pressing member 73 to absorb the heat from the sheet S effectively, a nip area between the elastic roll 71 and the pressing member 73 is formed widely.

The elastic roll 71 has the elastic layer 71*a* made from sponge rubber of silicone resin that is covered around a metallic core 71*b* having excellent mechanical strength. The elastic roll 71 is driven and rotated.

In the embodiment, the surface of the elastic layer 71*a* is untreated, but a metallic thin layer made of stainless, nickel or duralumin having excellent mechanical strength and high thermal conductivity may be provided on the surface of the elastic layer 71*a*, or other resins may be employed as far as they have the mechanical strength and high thermal conductivity. If such thin layer is provided, the heat absorbing action from the sheet S is positively made on the side of the elastic roll 71, further increasing the cooling effect.

Instead of the thin layer, a high releasing layer having excellent releasing ability, which is made of fluororesin or silicone resin, may be provided on the surface of the elastic roll 71. With the high releasing layer, the toner on the sheet S immediately after fixing is kept from sticking to the elastic roll 71, even in a semi-hardened state, thereby preventing image defects. Typical examples of fluororesin include PFA (tetrafluoroethylene-perfluoroalkylvinylether copolymer) and PTFE (polytetrafluoroethylene), and a typical example of silicone resin includes thermoplastic silicone rubber.

And to cover these materials on the surface of the elastic roll 71, a method of coating such as spraying, or putting a resin tube may be employed.

Moreover, these high releasing layers may be further formed on the metallic thin film.

On the other hand, it is necessary that the endless belt 72 has excellent mechanical strength and some heat resistance (about 100 to 120° C.). The endless belt may be made from a resin film of polyimide resin, but is preferably a thin layer belt made of metal such as stainless, nickel or duralumin to enhance the cooling effect of the sheet S. If the endless belt 72 is the thin layer belt made of metal, the thermal conductivity is more secured, and the heat absorbing action of the pressing member 73 is exhibited more effectively.

Though the metallic endless belt 72 is employed in the embodiment, the endless belt 72 may have a single layer structure or a composite layer structure, or a resin layer as the releasing layer may be provided on the surface of the metallic endless belt 72. As this resin layer, a fluororesin layer of PFA, PTFE, FEP (tetrafluoroethylene-hexafluoropropylene copolymer) may be formed, whereby the releasing ability is increased, the frictional force is decreased, the sheet transport performance is enhanced in tenaciously transporting the sheet S, and the occurrence of crumpled paper is suppressed.

A lubricant is applied on the inner circumferential face of the endless belt 72 to increase the sliding ability between the endless belt 72 and the pressing member 73, and rotate the endless belt 72 more smoothly.

As the lubricant, silicone oil, fluorine oil or grease thereof may be employed. To increase the cooling effect of the sheet S, a thermal conductive grease such as silicone oil compound in which powder having excellent thermal conductivity such as alumina is blended into silicone oil may be employed.

The pressing member 73 for pressing the endless belt 72 against the elastic roll 71 and absorbing heat from the sheet S by contacting with the endless belt 72 is disposed on the back of the endless belt 72.

The pressing member 73 has a base material made of metal such as stainless, aluminum, nickel, copper or zinc, or alloy thereof, and is composed of a pressing portion 73*a* for forming a nip area between the elastic roll 71 and it and having a space 74 bored internally, and a support portion 73*b* for supporting the pressing portion 73*a*.

The pressing member 73 is not limited to the metallic member, but may employ a heat pipe or heat sink, or a combination thereof, its shape being arbitrarily set, like a plate or roll, to conform with the shape to be formed. Also, the pressing portion 73*a* and the support portion 73*b* may be provided separately.

An arcuate belt travel guide 75 is provided in an inside part of the endless belt 72 where the pressing member 73 is out of contact with the endless belt 72 to suppress variation of the endless belt 72 during rotation and keep the smooth rotation and is connected to the support portion 73*b* of the pressing member 73.

The belt travel guide 75 may be made of metal or resin, as far as it has rigidity. The belt travel guide 75 is provided with a releasing layer made of fluororesin on the side of the endless belt 72. Thereby, even if the endless belt 72 contacts the belt travel guide 75, the frictional resistance is too small to hinder the rotation of the endless belt 72.

Figure 4:
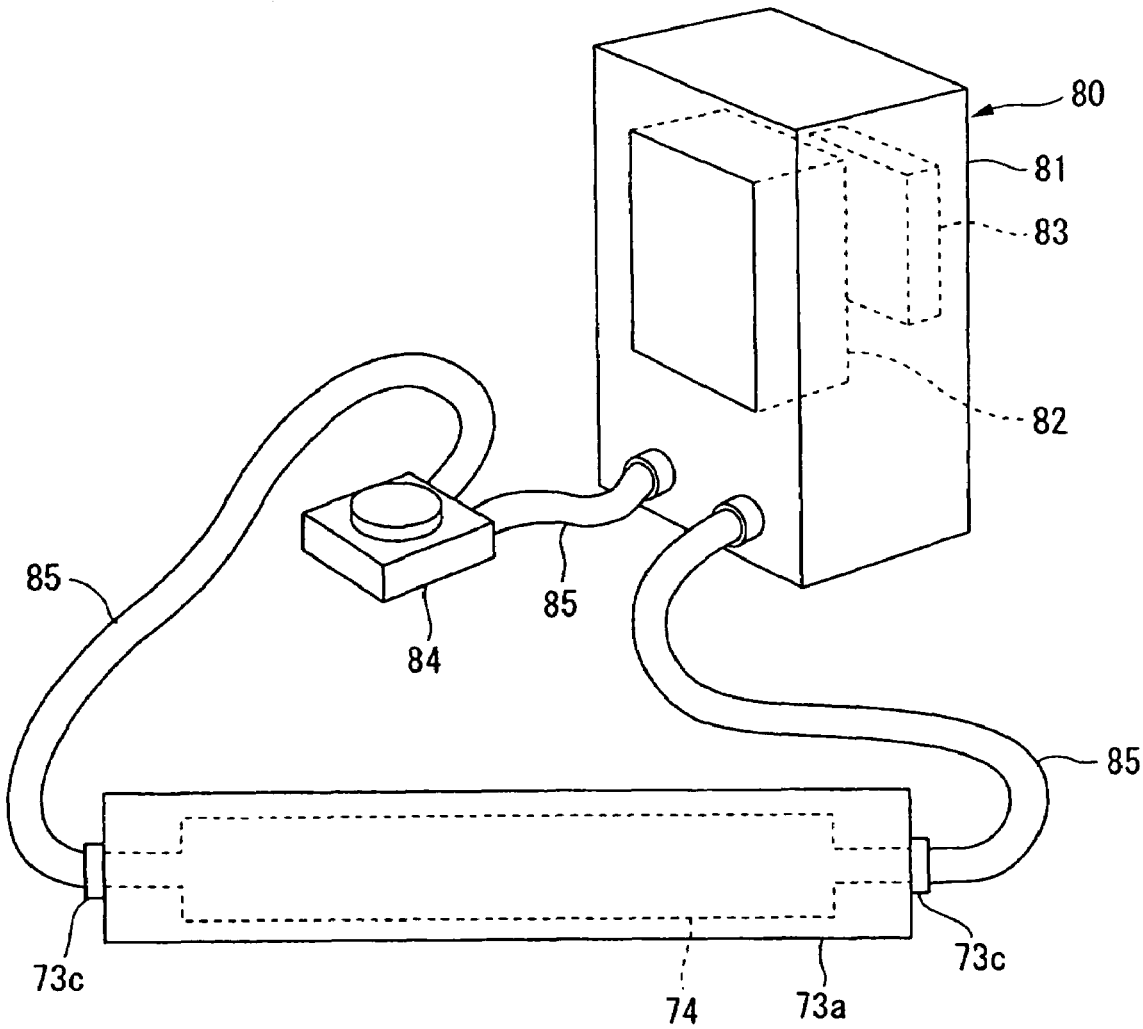
FIG. 4 is an explanatory view showing a water cooling device connected to the cooling transport device according to the second embodiment.

The cooling water flows through the space 74 within the pressing portion 73*a* of the pressing member 73. As shown in FIG. 4, a flexible hose 85 is joined with a copper pipe 73*c* connected to the space 74 within the pressing portion 73*a* and extending to both sides, the other end of the flexible hose 85 leading to a cooling device 80.

The cooling device 80 includes a radiator 82 for passing cooling water through the copper pipe extended inside an apparatus main body 81 and a fan 83 for sending air to the radiator 82, and a micro pump 84 joined to a plurality of flexible hoses 85 outside the apparatus main body 81 and pumping the cooling water to the cooling device 80 and the space 74 of the pressing portion 73*a* via the flexible hoses 85. Such cooling device 80 has the same configuration as the cooling device for the personal computer, and is attached within the apparatus main body 10 (see FIG. 2) of the image forming apparatus.

Referring to FIG. 2, the operation of a sheet transport system of the image forming apparatus in the embodiment will be described below.

The sheet fed out of any of the sheet feeding cassettes 51 to 53 is moved on the vertical transporting path 61, positioned and regulated by the registration roll 54 provided on the main transporting path 62, and moved to the secondary transfer device 35.

On the other hand, the toner images of colors transferred multiply on the intermediate transfer belt 30 by the image forming units 21 (21*a* to 21*d*) are carried on the intermediate transfer belt 30 and led to the second transfer device 35. And the multiple toner images on the intermediate transfer belt 30 are transferred collectively onto the sheet by the second transfer device 35. The sheet to which the toner images are transferred collectively is transported by the transporting belt 55, and led to the fixing device 40. Thereafter, the toner images are heated and fused, and fixed on the sheet by the fixing device 40. The sheet immediately after fixing is cooled by the cooling transport device 70, and the cooled sheet is moved on the main transporting path 62 and exhausted from the exhausting roll 56 onto the paper output tray 57.

Accordingly, since the toner is hardened, the sheets exhausted on the paper output tray 57 are prevented from sticking to each other due to adhesion of the toner, even though the exhausted sheets are stacked on the paper output tray 57.

In printing on both sides of the sheet, the sheet cooled by the cooling transport device 70 once takes refuge from the main transporting path 62 to the refuge transporting path 63. And when the trailing end of the sheet is beyond an entrance of the reversal transporting path 64 after the sheet is moved sufficiently on the refuge transporting path 63, a predetermined transporting roll on the refuge transporting path 63 performs the reversing operation, so that the sheet on the refuge transporting path 63 is reversely transported to the reversal transporting path 64. The sheet reversely transported is transported on the main transporting path 62 again, with the sheet inside out, and formed with a new toner image. Thereafter, the sheet is passed through the fixing device 40, the cooling transport device 70 and the sheet exhausting roll 56 and exhausted on the paper output tray 57.

In this case, since the sheet reversely transported by the cooling transport device 70 is cooled, it is possible to prevent the nonconformity from occurring on the transporting path due to exhaust heat of the sheet.

Referring principally to FIG. 3, the operation of the cooling transport device 70 will be described below.

The sheet, to which the toner T is transferred collectively, is heated by the fixing device 40, and inserted into the cooling transport device 70.

Within the cooling transport device 70, the sheet S is cooled in a predetermined nip area between the elastic roll 71 and the pressing member 73. At this time, the cooling water is circulated through the pressing member 73 by the cooling device 80 (see FIG. 4) to maintain the effect of absorbing heat from the sheet S. Also, in the embodiment, the endless belt 72, which is made of metal, has high thermal conductivity, whereby the heat absorbing effect from the sheet S to the pressing member 73 is further increased. Even if the endless belt 72 is a resin film of polyimide resin, for example, there is no hindrance on the heat absorbing effect from the sheet S with the pressing member 73 because its thickness is small.

Since the cooling transport device 70 is configured such that the elastic roll 71 and the pressing member 73 are oppositely disposed, and the endless belt 72 is sandwiched between them, and rolled by the elastic roll 71 to cool the pressing member 73, it is possible to effectively absorb heat from the sheet S at high temperatures exhausted from the fixing device 40 where the toner is heated and fused, thereby preventing various kinds of nonconformity from occurring due to exhaust heat of the sheet S.

Moreover, it is unnecessary to make the belt walk control of the endless belt 72, whereby the cooling transport device 70 is simplified and made smaller.

Moreover, since the toner T is located on the side of the elastic roller 71, it is possible to prevent the image disorder of the toner on the sheet S from occurring due to elastic deformation.

Figure 5A:
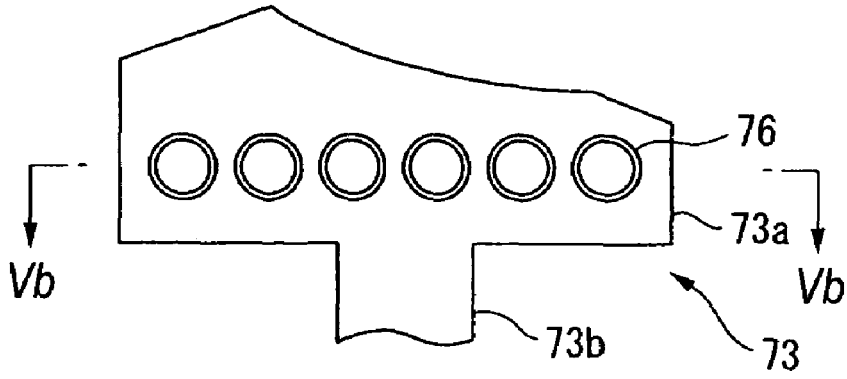
Figure 5B:
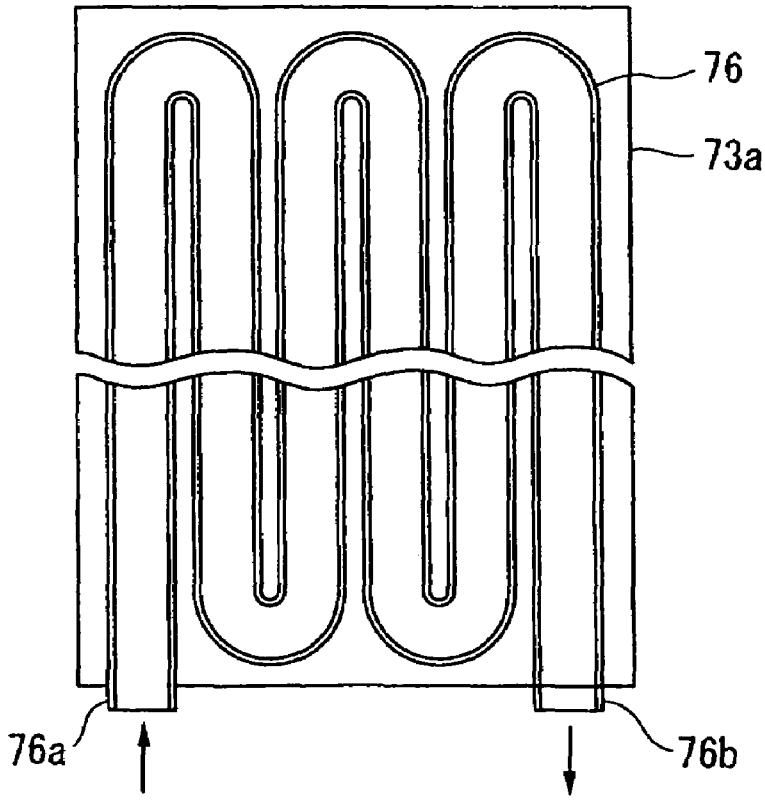

FIGS. 5A and 5B show the modified examples of the second embodiment, in which the pressing member 73 has a different configuration, there is no space 74 (see FIG. 3) within the pressing portion 73*a*, and a cooling pipe 76 composed of a copper pipe is extended within the pressing portion 73*a*. And in this example, the cooling pipe 76 is connected to the cooling device, not shown, to circulate the cooling water through the cooling pipe 76. FIG. 5B is a cross-sectional view taken along the line Vb-Vb shown in FIG. 5A.

Moreover, in this example, the entrance side 76*a* and the exit side 76*b* of cooling water of the cooling pipe 76 are disposed in the same direction, and built into the cooling transport device 70 (e.g., see FIG. 3) from one direction, whereby the configuration of the apparatus is simplified.

Since the cooling of the pressing member 73 is fully made in this configuration, there is the same effect as in the second embodiment.

Though the entrance side 76*a* and the exit side 76*b* of the cooling pipe 76 are provided in one direction in this example, it will be appreciated that the cooling pipe 76 may be appropriately selected in the shape, size and mounting pitch.

Third embodiment

Figure 6:
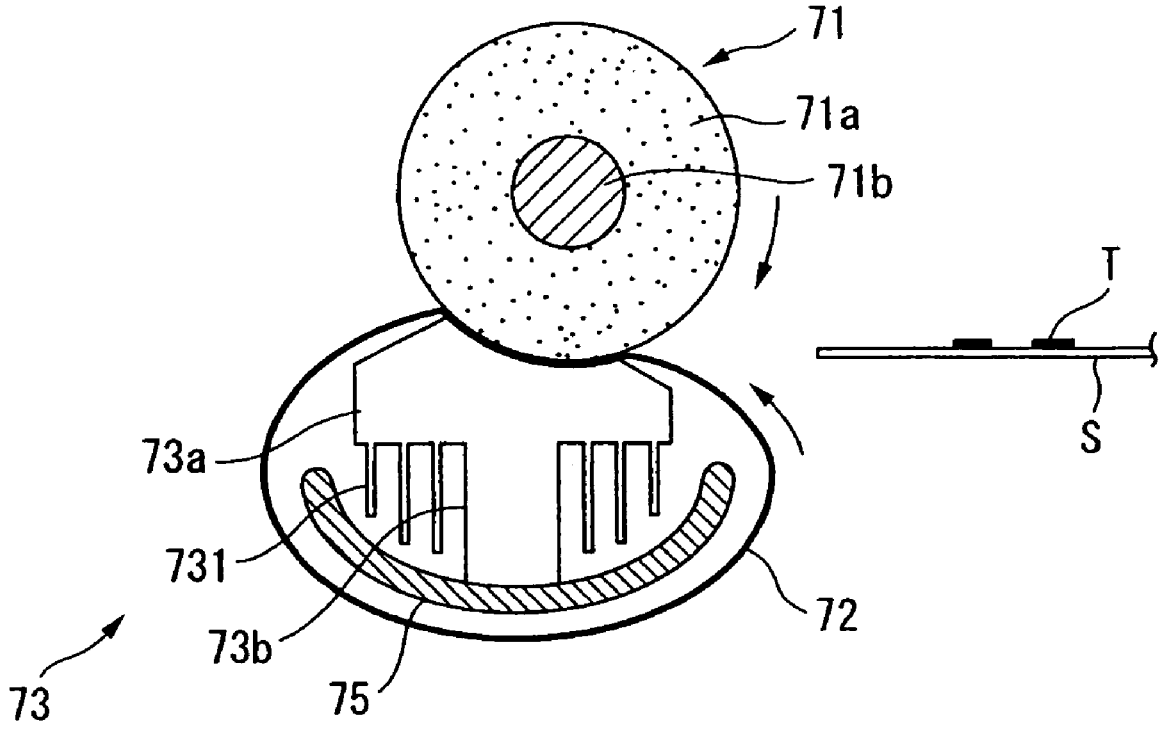
FIG. 6 is an explanatory view showing a cooling transport device according to a third embodiment.

FIG. 6 is a schematic view showing a cooling transport device for use in an image forming apparatus according to a third embodiment. In the cooling transport device of the third embodiment, unlike the cooling transport device (e.g., see FIG. 3) of the second embodiment, no cooling water is circulated through the pressing member, and no space is provided in the pressing member. The same parts are designated by the same numerals as in the second embodiment, and the explanation thereof is omitted.

The pressing member 73 of the embodiment is composed of the pressing portion 73*a* and the support portion 73*b*. Particularly, the pressing portion 73*a* is provided with a number of heat radiation fins 731 for promoting the heat radiation from the pressing member 73 along the axial direction of the elastic roll 71.

Therefore, the heat of the pressing portion 73*a* is radiated by the heat radiation fins 731 to keep the temperature of the pressing portion 73*a* from rising abnormally.

In this way, even if the cooling water is not circulated through the pressing portion 73*a*, the temperature of the pressing portion 73*a* is suppressed low, whereby the heat absorption from the sheet S is made effectively.

To increase the heat radiation effect from the heat radiation fins 731 and prevent the adverse influence of radiated heat on the image forming apparatus, air may be sent to the heat radiation fins 731, employing a sirocco fan, for example. Also, an air sending guide may be provided to prevent the air sent by the sirocco fan and warmed by the heat radiation fins 731 from flowing to the other parts of the image forming apparatus.

Accordingly, it is possible to keep the temperature of the pressing member 73 from rising without flowing the cooling water through the pressing member 73, whereby there is the same effect as in the second embodiment.

Though in the embodiment, the heat radiation fins 731 are provided on the side of the pressing portion 73*a* of the pressing member 73, they may be provided on the side of the support portion 73*b*.

Fourth Embodiment

Figure 7:
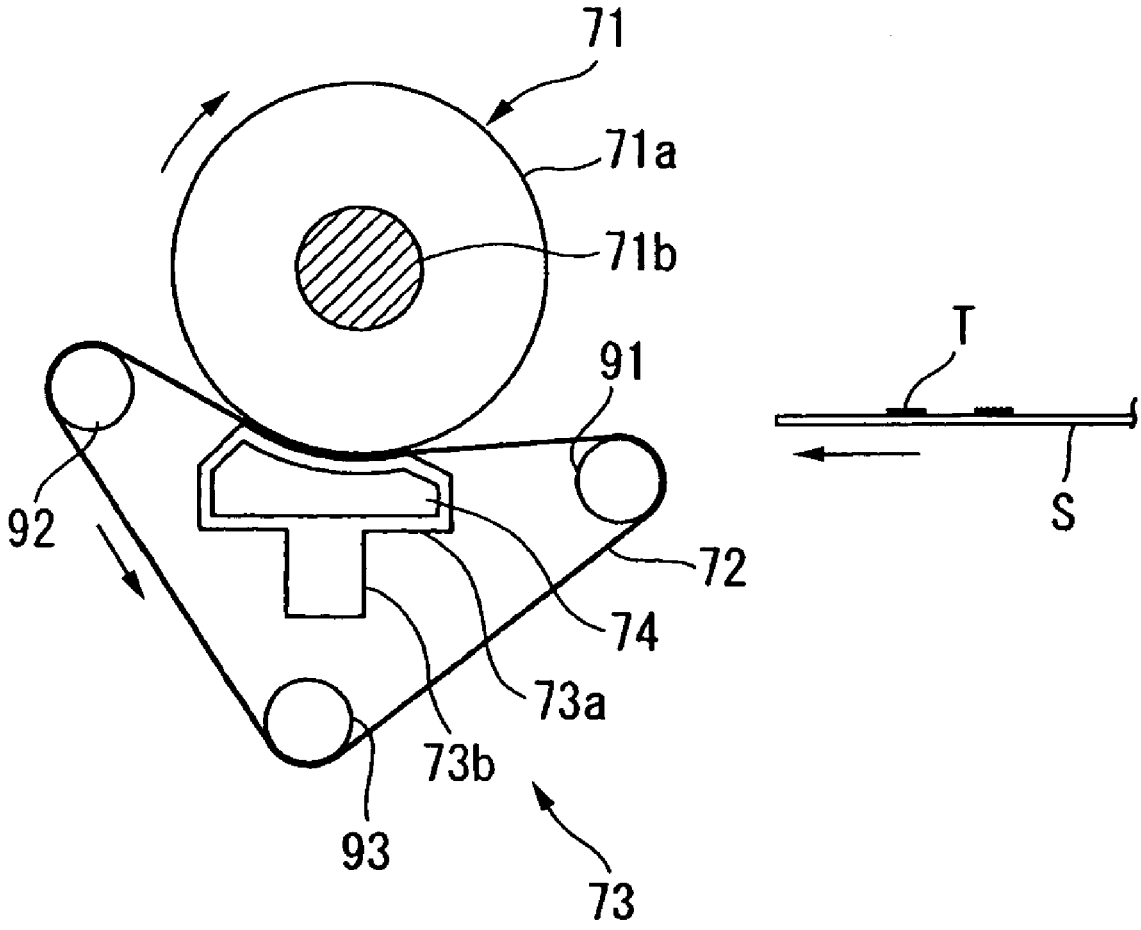
FIG. 7 is an explanatory view showing a cooling transport device according to a fourth embodiment.
Figure 8A:
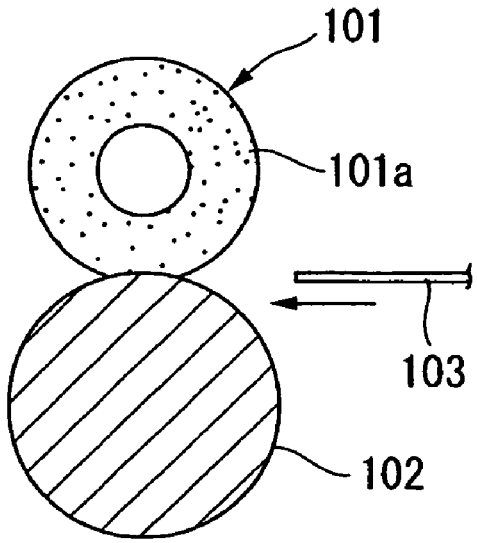
FIG. 8A RELATED ART
FIGS. 8A and 8B are explanatory views showing a conventional cooling transport device.
Figure 8B:
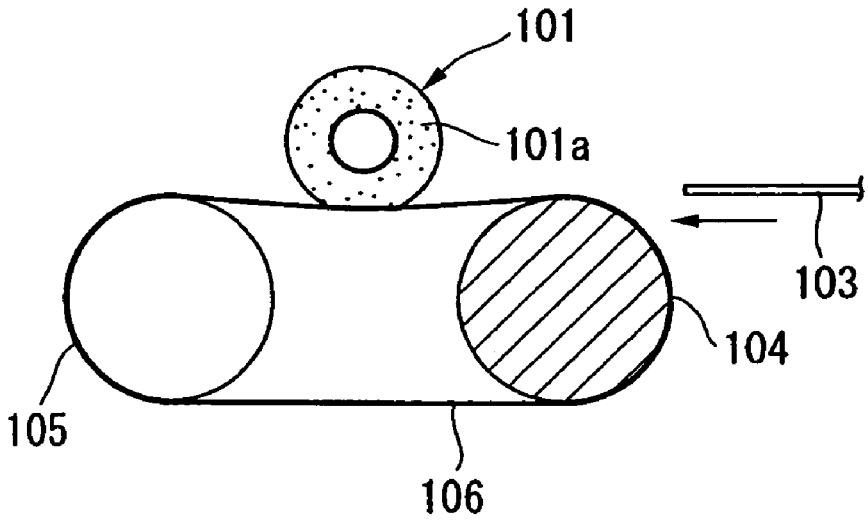
FIG. 8B RELATED ART

FIG. 7 is a schematic view showing a cooling transport device for use in an image forming apparatus according to a fourth embodiment of the invention. In the cooling transport device according to the fourth embodiment, unlike the cooling transport device (e.g., see FIG. 3) of the second embodiment, the endless belt is stretched. The same parts are designated by the same numerals as in the second embodiment, and the explanation thereof is omitted.

The endless belt 72 of the embodiment is stretched around three stretching rolls 91 to 93, and rotated. A nip area between the elastic roll 71 and the endless belt 72 is secured by pressing the pressing member 73 against the elastic roll 71, and a water cooling device, not shown, is connected to the space 74 of the pressing member 73, like the second embodiment.

Thus, in the embodiment, the nip area between the elastic roll 71 and the endless belt 72 is secured widely to increase the heat absorbing effect of the pressing member 73, and absorb the heat from the sheet S effectively.

EXAMPLE

An example has substantially the same configuration as the second embodiment, wherein the cooling effect of the cooling transport device is evaluated and confirmed.

In this example, the elastic roll is composed of a sponge-like elastic layer made of foamed silicone resin that is covered around a stainless metallic core, a stainless tube having a thickness of 30 μm that is covered on the surface of this elastic layer, and further a PFA tube having a thickness of 30 μm that is covered on the surface. The elastic roll has an outer diameter of 26 mm and a length of 360 mm.

On the other hand, the endless belt has a nickel electrocast belt having an inner diameter of 30 mm, a thickness of 50 μm and a length of 330 mm as a base material and coated with PFA having a thickness of 30 μm as a releasing layer on its outer circumferential surface. Also, amino denatured silicone oil having a viscosity of 0.3 Pa×s as a lubricant is applied on the inner surface of the endless belt to reduce the friction between the endless belt and the pressing member.

The pressing member is made of aluminum alloy with a space inside, and joined via a stainless pipe to the external water cooling device to allow the cooling water to circulate. And the pressure of the pressing member is adjusted so that the nip area between the pressing member and the elastic roll may be 15 mm in width (length along the sheet transport direction).

Moreover, a belt travel guide made of PBT resin is firmly supported in the pressing member, so that the endless belt is rotated smoothly.

By rotating the elastic roll under such conditions, when the peripheral speed of the elastic roll and the endless belt was 104 mm/sec, the cooling effect was measured using the one-side coated paper having a basis weight of 127 g/m$^2$ as the sheet. The following results were obtained.

A difference between the toner surface temperature after fixing by the fixing device and the surface temperature after passing through the cooling transport device was 15° C.

To confirm the stability of this cooling transport device, 10000 sheets were continuously supplied by the same method as above. As a result, there was no failure such as crease or wrinkle in the endless belt or no disorder caused by passing the image after fixing through the cooling transport device.

Thereby, the advantage of the invention is confirmed.

As described in detail with reference to the embodiments, since the cooling transport device includes a rotating member with an elastic layer, a belt member for transporting a recording medium between the rotating member and it, the belt member rolling along with the rotating member, and a heat absorbing pressing member for pressing the belt member in a predetermined nip area against the rotating member and absorbing heat from the recording medium, the heat absorbing pressing member being provided on the inner surface side of the belt member, the nip area between the rotating member and the belt member can be widely taken, and the cooling of the recording medium can be effectively made.

An image forming apparatus in which the image quality is not affected by the exhausted heat from the recording medium after fixing can be provided by using the cooling transport device.

Although the present invention has been shown and described with reference to the embodiments, various changes and modifications will be apparent to those skilled in the art from the teachings herein. Such changes and modifications as are obvious are deemed to come within the spirit, scope and contemplation of the invention as defined in the appended claims.

The entire disclosure of Japanese Patent Application No. 2005-073454 filed on Mar. 15, 2005 including specification, claims, drawings and abstract is incorporated herein by reference in its entirety.

What is claimed is:

1. A cooling transport device comprising:

a rotating member that is provided with an elastic layer;

an endless belt member that transports a recording medium between the rotating member and the belt member, the belt member being in contact under pressure with the rotating member to form a nip area and rotated by the rotating member; and a heat absorbing pressing member that presses the belt member in the nip area against the rotating member and absorbs heat from the recording medium, the heat absorbing pressing member being provided on the inner surface side of the belt member.

2. The cooling transport device according to claim 1, wherein the heat absorbing pressing member is connected to a cooling device that circulates a cooling medium inside the heat absorbing pressing member.

3. The cooling transport device according to claim 2, wherein the cooling device is a water cooling device.

4. The cooling transport device according to claim 1, wherein the heat absorbing pressing member is provided with a heat radiation member that radiates at least part of heat absorbed from the recording medium.

5. The cooling transport device according to claim 1, wherein at least one of the belt member and the heat absorbing pressing member is provided with a low friction layer on a contacting face thereof, the low friction layer reducing the frictional resistance between the belt member and the heat absorbing pressing member.

6. The cooling transport device according to claim 5, wherein the low friction layer is formed by coating the inner surface of the belt member with a lubricant.

7. The cooling transport device according to claim 1, wherein the belt member is made of metal.

8. The cooling transport device according to claim 1, wherein a surface of the rotating member is provided with a heat conductive layer having a heat conductivity higher than that of the rotating member.

9. The cooling transport device according to claim 1, wherein a surface of the rotating member is provided with a releasing layer.

10. The cooling transport device according to claim 1, wherein the width of the nip area between the rotating member and the belt member in a direction of a rotation axis of the rotating member is larger than a maximum width of the recording medium.

11. The cooling transport device according to claim 1, wherein the rotating member is provided with a drive source that rotates the rotating member, and wherein the belt member is in contact with the rotating member at the nip area and rotated by the rotating member.

12. The cooling transport device according to claim 11 further comprising a guide member that guides a moving path of the belt member, the guide member being provided on the inner surface side of the belt member.

13. An image forming apparatus comprising:

an image carrier that carries a toner image;

a transfer unit that transfers the toner image on the image carrier onto a recording medium;

a fixing unit that heats and fixes the toner image transferred onto the recording medium; and a cooling transport device that cools the recording medium after the toner image being fixed thereon, the cooling transport device including:

a rotating member that is provided with an elastic layer;

an endless belt member that transports a recording medium between the rotating member and the belt member, the belt member being in contact under pressure with the rotating member to form a nip area and being rotated by the rotating member; and a heat absorbing pressing member that presses the belt member in the nip area against the rotating member and absorbs heat from the recording medium, the heat absorbing pressing member being provided on the inner surface side of the belt member.

14. The image forming apparatus according to claim 13, wherein the recording medium is transported in a manner that the fixed toner image faces the side of the rotating member.

* * * * *